US010337509B2

(12) United States Patent
Watanabe

(10) Patent No.: US 10,337,509 B2
(45) Date of Patent: Jul. 2, 2019

(54) INTERNAL GEAR PUMP

(71) Applicant: TOYOOKI KOGYO CO., LTD., Okazaki-shi, Aichi (JP)

(72) Inventor: Noritaka Watanabe, Okazaki (JP)

(73) Assignee: TOYOOKI KOGYO CO., LTD., Okazaki-Shi, Aichi (JP)

( * ) Notice: Subject to any disclaimer, the term of this patent is extended or adjusted under 35 U.S.C. 154(b) by 257 days.

(21) Appl. No.: 15/505,162

(22) PCT Filed: Aug. 4, 2015

(86) PCT No.: PCT/JP2015/072134
§ 371 (c)(1),
(2) Date: Feb. 20, 2017

(87) PCT Pub. No.: WO2016/056295
PCT Pub. Date: Apr. 14, 2016

(65) Prior Publication Data

US 2017/0268504 A1 Sep. 21, 2017

(30) Foreign Application Priority Data

Oct. 7, 2014 (JP) ..... 2014-206065

(51) Int. Cl.
*F04C 2/08* (2006.01)
*F04C 2/10* (2006.01)
(Continued)

(52) U.S. Cl.
CPC ..... *F04C 2/084* (2013.01); *F04C 2/10* (2013.01); *F04C 15/00* (2013.01); *F04C 18/084* (2013.01);
(Continued)

(58) Field of Classification Search
CPC .. F04C 2250/301; F04C 15/00; F04C 18/084; F04C 18/10; F04C 2240/20; F04C 2/084; F04C 2/10
See application file for complete search history.

(56) References Cited

U.S. PATENT DOCUMENTS 6,077,059 A 6/2000 Hosono
8,632,323 B2 * 1/2014 Uozumi ..... F04C 2/084 418/150
(Continued)

FOREIGN PATENT DOCUMENTS

JP 61201892 9/1986
JP 2004-197670 7/2004
(Continued)

OTHER PUBLICATIONS

International Preliminary Report on Patentability from corresponding PCT Appln. No. PCT/JP2015/072134 dated Apr. 11, 2017. English translation attached.
(Continued)

*Primary Examiner* — Mary Davis
(74) *Attorney, Agent, or Firm* — Grossman, Tucker, Perreault & Pfleger, PLLC

(57) ABSTRACT

Provided is an internal gear pump. The shape of any one of a plurality of external teeth and a plurality of internal teeth of the pump is formed on the basis of formulae (1)-(5).

$r=ro-dr\cdot\cos\theta$, Formula (1):

$Px=(ro-dr)+1/4dr\{1-\cos(2\theta)\}$, Formula (2):

$Py=1/4dr\{-2\theta+\sin(2\theta)\}$, Formula (3):

$Qx=Px-r\cdot\cos\theta$, Formula (4):

$Qy=Py+r\cdot\sin\theta$ Formula (5):.

1 Claim, 4 Drawing Sheets

(51) Int. Cl.
*F04C 15/00* (2006.01)
*F04C 18/08* (2006.01)
*F04C 18/10* (2006.01)

(52) U.S. Cl.
CPC ..... *F04C 18/10* (2013.01); *F04C 2240/20* (2013.01); *F04C 2250/301* (2013.01)

(56) References Cited

U.S. PATENT DOCUMENTS

| | | | |
|---|---|---|---|
| 9,091,263 | B2 | 7/2015 | Uozumi et al. |
| 2013/0112028 | A1 | 5/2013 | Fujiki et al. |

FOREIGN PATENT DOCUMENTS

| | | |
|---|---|---|
| JP | 2013-100762 | 5/2013 |
| JP | 2013-227871 | 11/2013 |
| WO | 2013/108553 | 7/2013 |

OTHER PUBLICATIONS

International Search Report from corresponding PCT Appln. No. PCT/JP2015/072134 dated Nov. 10, 2015. English translation attached.
Extended European Search Report from related EP Appln. No. 15849177.9 dated Mar. 5, 2018.

* cited by examiner

INTERNAL GEAR PUMP

CROSS-REFERENCE TO RELATED APPLICATIONS

This international application claims the benefit of Japanese Patent Application No. 2014-206065 filed Oct. 7, 2014 in the Japan Patent Office, and the entire disclosure of Japanese Patent Application No. 2014-206065 is incorporated herein by reference.

TECHNICAL FIELD

The present disclosure relates to an internal gear pump in which a plurality of internal teeth of an internally toothed gear internally mesh with a plurality of external teeth of an externally toothed gear. In particular, the externally toothed gear is eccentric to the internally toothed gear and is accommodated inside the internally toothed gear. Further, in the present disclosure, the number of teeth of the plurality of internal teeth is one greater than the number of teeth of the plurality of external teeth.

BACKGROUND ART

In this type of internal gear pump, a ring-shaped internally toothed gear provided with a plurality of internal teeth is rotatably accommodated in a housing hole of a pump housing. An externally toothed gear provided with a plurality of external teeth which internally mesh with the plurality of internal teeth of the internally toothed gear is eccentrically accommodated in the internally toothed gear with respect to the internally toothed gear. The internally toothed gear is rotated by a rotational drive of the externally toothed gear, whereby a liquid is sucked from a suction port into a space defined by the plurality of external teeth and the plurality of internal teeth. The liquid is discharged from a discharge port through the space.

The shape of individual external teeth of the externally toothed gear is designed using a base circle and a rolling circle rolling without slipping around the base circle. Specifically, a fixed point is provided at a position spaced from a center of the rolling circle by an eccentricity between a center of the externally toothed gear and a center of the internally toothed gear. A trajectory (curve) drawn by the fixed point when the rolling circle rolls without slipping around the base circle is a trochoid curve. Then, a circle having a predetermined radius and having its center on the trochoid curve is drawn. An envelope of the circle forms the shape of individual teeth of the externally toothed gear.

The internal gear pump as such is described in, for example, Patent Document 1 and so on.

PRIOR ART DOCUMENTS

Patent Documents

Patent Document 1: Japanese Unexamined Patent Application Publication No. 61-201892

SUMMARY OF THE INVENTION

Problems to be Solved by the Invention

In the conventional internal gear pump, as described above, the individual external teeth are formed by using a trochoid curve. In this case, in order to increase a tooth height, in addition to reduce an outer diameter of the internally toothed gear for the purpose of reducing the size of the internal gear pump and to increase the eccentricity between the center of the externally toothed gear and the center of the internally toothed gear for the purpose of not reducing a discharge amount (maintaining the discharge amount), it is inevitable to reduce a tooth width. Then, the tooth width becomes excessively small sometimes, and so it is difficult to ensure adequate performance (for example, durability).

It is desirable to provide an internal gear that can obtain a desired discharge amount while achieving size reduction. In the internal gear pump, it is desirable that substantially the same minimum clearance between corresponding (opposed) teeth of a plurality of external teeth and a plurality of internal teeth is not impaired over the entire circumference. It is desirable to make an outer diameter of the internally toothed gear smaller. It is desirable that a tooth height of the plurality of external teeth and a tooth height of the plurality of internal teeth can be made higher. Specifically, it is preferable that the durability is not impaired even if the tooth height of the plurality of external teeth and the tooth height of the plurality of internal teeth are made higher.

Means for Solving the Problems

In a first aspect of the present disclosure, the following internal gear pump is provided.

An internal gear pump that accommodates: a ring-shaped internally toothed gear provided with a plurality of internal teeth, and an externally toothed gear provided with a plurality of external teeth that internally mesh with the plurality of internal teeth, the externally toothed gear being eccentrically disposed inside the internally toothed gear, the number of the plurality of internal teeth being one greater than the number of the plurality of external teeth, wherein, in any one of the plurality of external teeth and the plurality of internal teeth, a tooth tip section and an meshing section are formed by a curve having one continuous curvature, and the curve is formed by Formulae (1) to (5) below with which a minimum curvature is at an apex of a tooth tip, and the curvature gradually increases towards a tooth bottom.

$$r=ro-dr\cdot\cos\theta, \quad \text{Formula (1):}$$

$$Px=(ro-dr)+1/4dr\{1-\cos(2\theta)\}, \quad \text{Formula (2):}$$

$$Py=1/4dr\{-2\theta+\sin(2\theta)\}, \quad \text{Formula (3):}$$

$$Qx=Px-r\cdot\cos\theta, \text{ and} \quad \text{Formula (4):}$$

$$Qy=Py+r\cdot\sin\theta, \quad \text{Formula (5):}$$

where r is a radius of a curve, ro is a reference diameter, dr is a variation, where dr<0, θ is a parameter, Px is an X coordinate of a trajectory center, Py is a Y coordinate of the trajectory center, Qx is an X coordinate of a point on a curve generated by the trajectory center (Px, Py), and Qy is a Y coordinate of the point on the curve generated by the trajectory center (Px, Py).

Effects of the Invention

According to the present disclosure, any one of the plurality of external teeth and the plurality of internal teeth is formed as follows. Specifically, the tooth tip section and the meshing section are formed by a curve having one continuous curvature. In this curve, the minimum curvature is at the apex of the tooth tip, and the curvature gradually increases towards the tooth bottom. By increasing the curvature while moving a trajectory center of the curve, substantially the same minimum clearance between the corresponding (opposed) teeth of the plurality of external teeth and the plurality of internal teeth is maintained over the entire circumference, and the tooth height can be increased. As a result, the outer diameter of the internally toothed gear can be further reduced, and the size of the internally toothed gear can be reduced. Accordingly, the size of the internal gear pump can be reduced. Further, it becomes easy to secure a desired discharge amount.

EXPLANATION OF REFERENCE NUMERALS

1 . . . internally toothed gear, 1A . . . internal tooth, 3 . . . externally toothed gear, 3A . . . external tooth, 7A, 8A . . . tooth tip section, 7B, 8C: meshing section, L . . . curve

MODE FOR CARRYING OUT THE INVENTION

Hereinafter, an embodiment of the present disclosure will be described with reference to the drawings.

Figure 1:
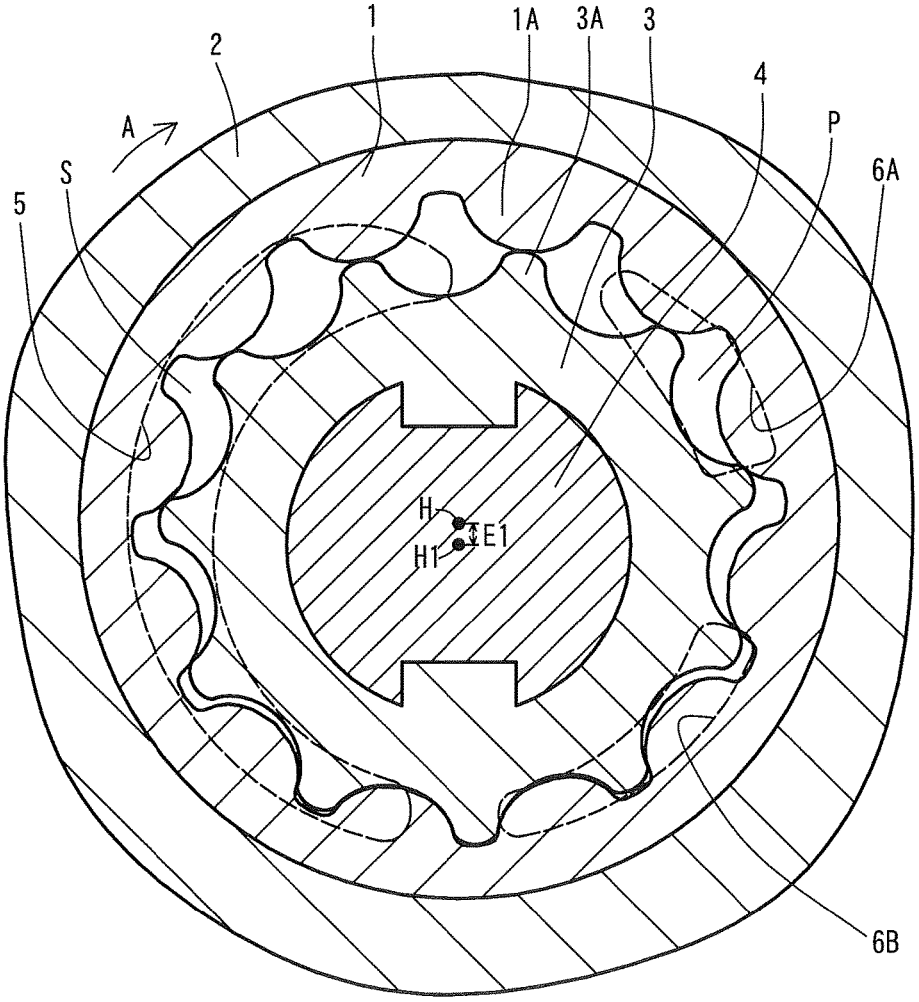
FIG. 1 is a cross-sectional view of an internal gear pump according to one embodiment.

In FIG. 1, a ring-shaped internally toothed gear 1 has twelve internal teeth 1A and is accommodated in a housing 2 so as to be rotatable about a rotation center H.

An externally toothed gear 3 has eleven external teeth 3A that internally mesh with the twelve internal teeth 1A and is accommodated inside the internally toothed gear 1 so as to be rotatable about a rotation center H1 eccentric to the rotation center H.

An eccentricity E1 between the internally toothed gear 1 and the externally toothed gear 3 is defined as a dimension (distance) between the rotation center H of the internally toothed gear 1 and the rotation center H1 of the externally toothed gear 3.

A drive shaft 4 rotationally drives the externally toothed gear 3 and engages with the externally toothed gear 3. A suction port 5 for sucking oil is in communication with a sucking space S whose volume can be increased by rotation of the internally toothed gear 1 and the externally toothed gear 3. Two discharge ports 6A and 6B for discharging oil are in communication with a discharge space P whose volume can be reduced by the rotation of the internally toothed gear 1 and the externally toothed gear 3. The two discharge ports 6A and 6B are spaced apart along a rotation direction A of the internally toothed gear 1 and the externally toothed gear 3.

Figure 2:
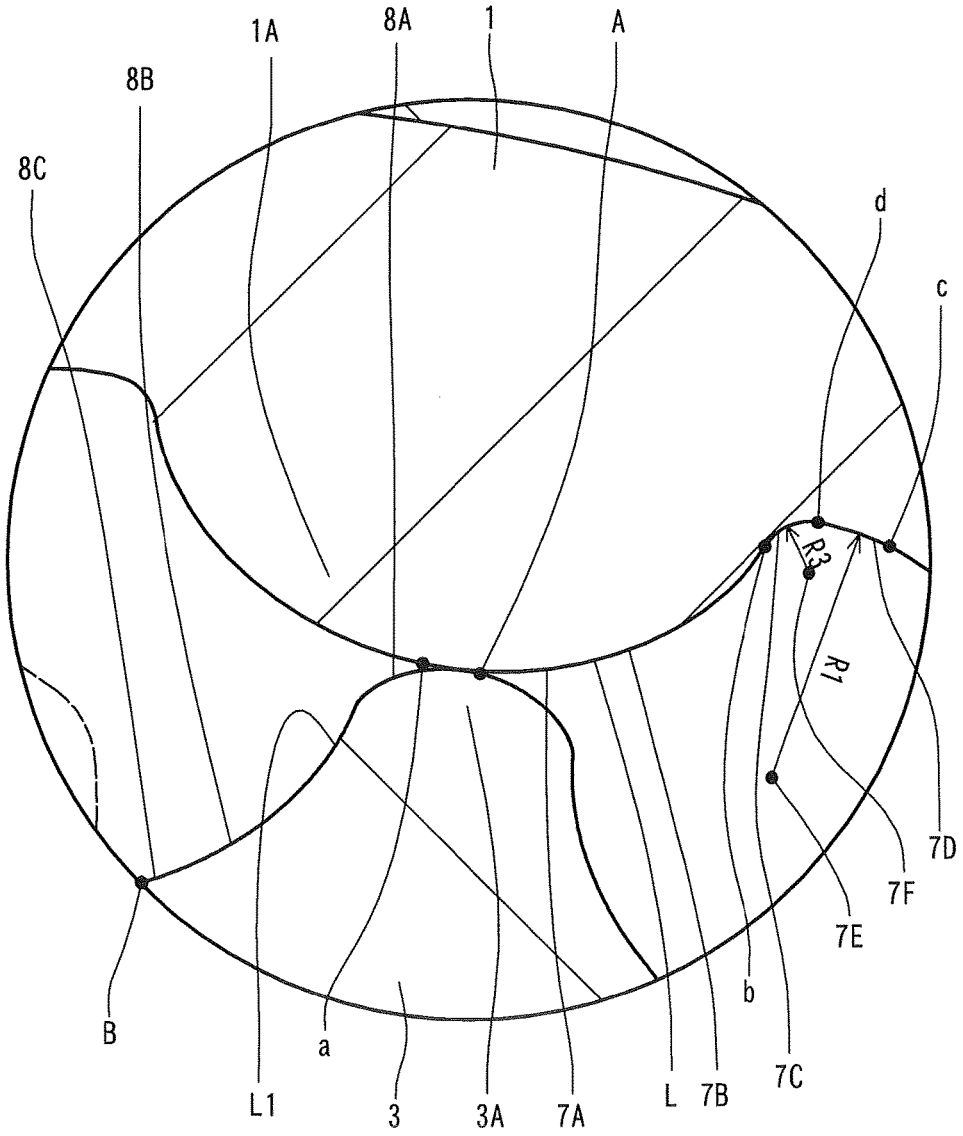
FIG. 2 is a partial enlarged view of the internal gear pump.

In FIG. 2, one internal tooth 1A comprises a tooth tip section 7A, a meshing section 7B, a connecting section 7C, and a tooth bottom section 7D, from a tooth tip toward a tooth bottom, from which a right half of one internal tooth 1A (right half from an apex a) is formed.

A left half from the apex a of the tooth tip is formed symmetrical to the right half with respect to a straight line passing the center H (see FIG. 1) of the internally toothed gear 1 and the apex a. The tooth tip section 7A and the meshing section 7B are formed by a curve L in which a minimum curvature is at the apex a and the curvature gradually increases towards the tooth bottom. Specifically, the shape between the points a and b is formed based on the following Formulae (1) to (5).

$$r=ro-dr\cdot\cos\theta, \quad \text{Formula (1):}$$

$$Px=(ro-dr)+1/4dr\{1-\cos(2\theta)\}, \quad \text{Formula (2):}$$

$$Py=1/4dr\{-2\theta+\sin(2\theta)\}, \quad \text{Formula (3):}$$

$$Qx=Px-r\cdot\cos\theta, \text{ and} \quad \text{Formula (4):}$$

$$Qy=Py+r\cdot\sin\theta, \quad \text{Formula (5):}$$

where r is a radius of a curve, ro is a reference diameter, dr is a variation, where dr<0, θ is a parameter, Px is an X coordinate of a trajectory center, Py is a Y coordinate of the trajectory center, Qx is an X coordinate of a point on a curve generated by the trajectory center (Px, Py), and Qy is a Y coordinate of the point on the curve generated by the trajectory center (Px, Py).

Figure 3:
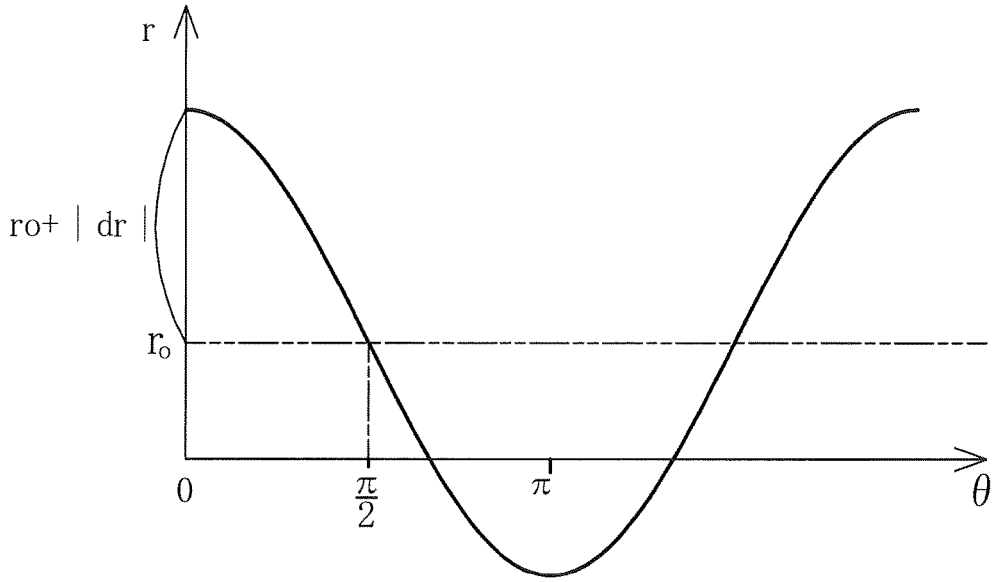
FIG. 3 is a schematic diagram of a tooth profile according to Formula (1).

FIG. 3 shows a curve in which a vertical axis represents the radius r of the curve L and a horizontal axis represents the parameter θ. It is also shown that r changes from ro+|dr| to ro as θ changes from 0 to π/2.

Figure 4:
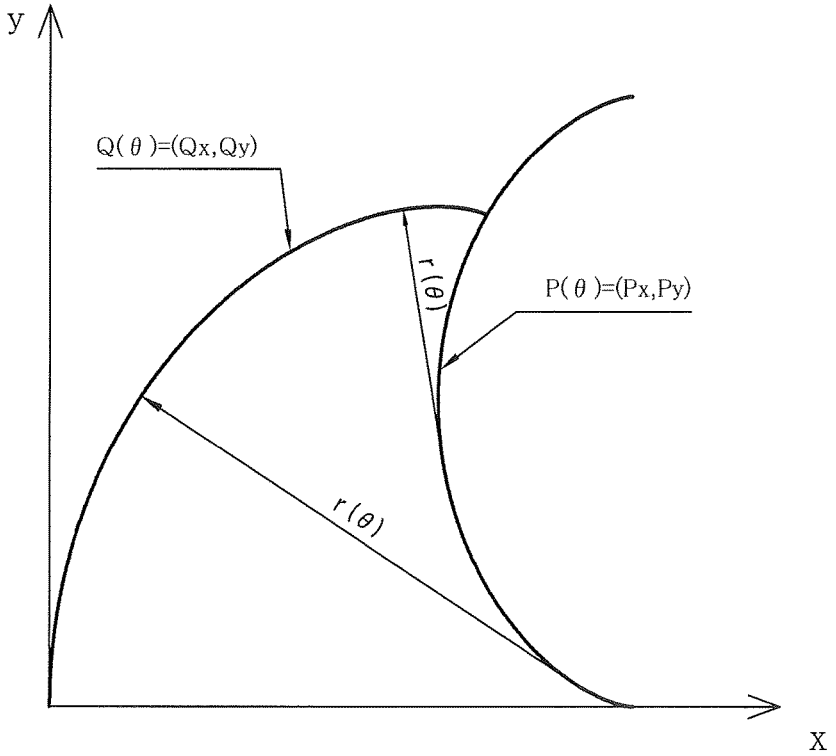
FIG. 4 is a schematic diagram of a tooth profile according to Formulae (2) to (5).

FIG. 4 shows that X, Y coordinates of a trajectory center P having the radius r forming the curve L and X, Y coordinates of a point Q on the curve L generated by the trajectory center P change in accordance with the parameter θ.

As shown in FIG. 2, the tooth bottom section 7D is formed into an arc shape having a center 7E and a radius R1, and connects points c and d. The arc having the radius R1 is an arc slightly larger than an envelope curve created by a tooth tip section 8A of one externally toothed gear 3A to be described later. The center 7E is located on a line passing the rotation center H (see FIG. 1) of the internally toothed gear 1 and a center of the tooth bottom section 7D (a midpoint of a line segment cd). The connecting section 7C is formed into an arc shape having a center 7F and a radius R3, and connects the points b and d.

One external tooth 3A comprises the tooth tip section 8A, a meshing section 8B, and a tooth bottom section 8C. The tooth tip section 8A, the meshing section 8B, and the tooth bottom section 8C are formed by an envelope curve L1 created by the curve L forming the tooth tip section 7A and the meshing section 7B of one internal tooth 1A. The envelope curve L1 connects a point A of the tooth tip section 8A and a point B of the tooth bottom section 8C.

Figure 5:
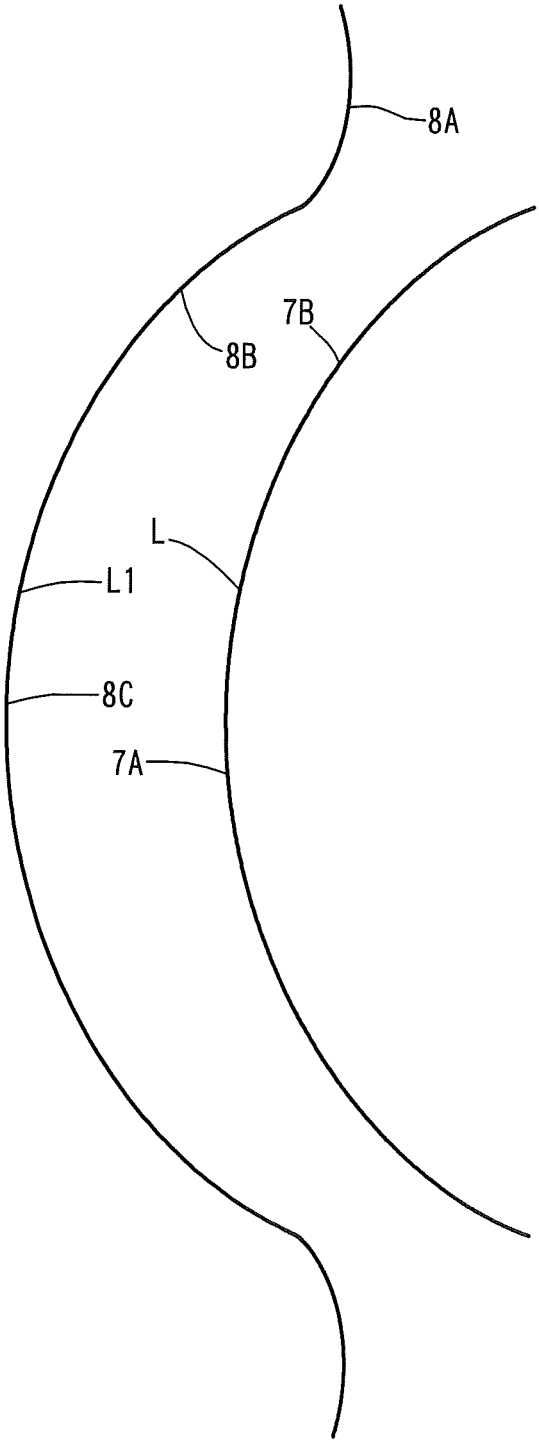
FIG. 5 is a schematic diagram of an envelope curve L1 created by a curve L that forms a tooth tip section and a meshing section.

FIG. 5 shows the envelope curve L1 created by the curve L forming the tooth tip section 7A and the meshing section 7B of one internal tooth 1A. The envelope curve L1 forms the tooth tip section 8A, the meshing section 8B, and the tooth bottom section 8C.

Operation of the internal gear pump of the present disclosure will be described.

When the externally toothed gear 3 is rotationally driven in a rotation direction A by the drive shaft 4, the internally toothed gear 1 that internally meshes with the externally toothed gear 3 is rotationally driven, and oil sucked into the suction space S from the suction port 5 is discharged from the discharge ports 6A and 6B through the discharge space P. Since a minimum clearance between the corresponding (opposed) teeth of the plurality of external teeth 3A and the plurality of internal teeth 1A is configured to be substantially the same over the entire circumference, sealability with the plurality of external teeth 3A and the plurality of internal teeth 1A can be maintained and a leakage from the discharge port 6A to the discharge port 6B or a leakage from the discharge port 6B to the discharge port 6A can be reduced (leakage can be suppressed).

In one internal tooth 1A, the tooth tip section 7A and the meshing section 7B are formed by the curve L having one continuous curvature, and the curve L is formed such that the minimum curvature is at the apex a of the tooth tip and the curvature gradually increases towards the tooth bottom.

Therefore, since the envelope curve L1 that is created by the curve L forming the tooth tip section 7A and the meshing section 7B of one internal tooth 1A and that forms the tooth tip section 8A, the meshing section 8B and the tooth bottom section 8C of one external tooth 3A is not a crossed curve between the tooth tip section 8A and the meshing section 8B, the minimum clearance between the corresponding (opposed) teeth of the plurality of external teeth 3A and the plurality of internal teeth 1A can be made substantially the same over the entire circumference.

Further, since the tooth tip section 7A and the meshing section 7B are formed by a curve having one continuous curvature, and the curve is formed such that the minimum curvature is at the apex a of the tooth tip and the curvature gradually increases towards the tooth bottom, a tooth height can be increased. Therefore, the outer diameter of the internally toothed gear 1 can be further reduced, and the size of the internal gear pump can be reduced.

In one embodiment, the tooth tip section 7A and the meshing section 7B of one internal tooth 1A is formed by the curve L in which the minimum curvature is at the apex a of the tooth tip and the curvature gradually increases towards the tooth bottom, and the tooth tip section 8A, the meshing section 8B, and the tooth bottom section 8C of the external tooth 3A are formed by the envelope curve L1 generated by the curve L. To the contrary, the tooth tip section and the meshing section of one external tooth 3A may be formed by a curve in which the minimum curvature is at an apex of the tooth tip and a curvature gradually increases towards the tooth bottom, and the tooth tip section, the meshing section, and the tooth bottom section of one internal tooth 1A may be formed by an envelope curve created by the curve that forms the tooth tip section and the meshing section of one external tooth 3A.

The invention claimed is:

1. An internal gear pump that accommodates: a ring-shaped internally toothed gear provided with a plurality of internal teeth, and an externally toothed gear provided with a plurality of external teeth which internally mesh with the plurality of internal teeth of the internally toothed gear, the externally toothed gear being eccentrically disposed inside the internally toothed gear, the number of the plurality of internal teeth being one greater than the number of the plurality of external teeth, wherein, in any one of the plurality of external teeth and the plurality of internal teeth, a tooth tip section and a meshing section are formed by a curve having one continuous curvature, the curve being formed by Formulae (1) to (5) below with which a minimum curvature is at an apex of a tooth tip, and the curvature gradually increases towards a tooth bottom.

$$r=ro-dr\cdot\cos\theta, \quad \text{Formula (1):}$$

$$Px=(ro-dr)+1/4dr\{1-\cos(2\theta)\}, \quad \text{Formula (2):}$$

$$Py=1/4dr\{-2\theta+\sin(2\theta)\}, \quad \text{Formula (3):}$$

$$Qx=Px-r\cdot\cos\theta, \text{ and} \quad \text{Formula (4):}$$

$$Qy=Py+r\cdot\sin\theta, \quad \text{Formula (5):}$$

where r is a radius of a curve, ro is a reference diameter, dr is a variation, where dr<0, θ is a parameter, Px is an X coordinate of a trajectory center, Py is a Y coordinate of the trajectory center, Qx is an X coordinate of a point on a curve generated by the trajectory center (Px, Py), and Qy is a Y coordinate of the point on the curve generated by the trajectory center (Px, Py).

* * * * *